United States Patent [19]

Knight

[11] Patent Number: 4,505,481

[45] Date of Patent: Mar. 19, 1985

[54] INFLATABLE TARGET APPARATUS

[75] Inventor: Lindsay C. Knight, Albury, Australia

[73] Assignee: Australasian Training Aids (Pty.) Ltd., Albury, Australia

[21] Appl. No.: 511,304

[22] Filed: Jul. 6, 1983

[30] Foreign Application Priority Data

Jul. 6, 1982 [GB] United Kingdom ..... 8219547

[51] Int. Cl.[3] ..... F41J 5/04; F41J 9/02

[52] U.S. Cl. ..... 273/348.1; 52/2; 273/369; 273/372; 273/407

[58] Field of Search ..... 273/359, 348.1, 366–370, 273/372, 406, 407, 380; 52/2; 104/290, 120; 46/90; 40/214

[56] References Cited

U.S. PATENT DOCUMENTS

| | | | |
|---|---|---|---|
| 2,112,264 | 3/1938 | Bowles et al. | 104/290 X |
| 3,048,127 | 8/1962 | Oberpaul | 104/120 X |
| 3,115,845 | 12/1963 | Girz | 104/120 X |
| 3,166,799 | 1/1965 | Birnkrant | 52/2 X |
| 3,198,139 | 8/1965 | Dark | 104/290 X |
| 3,330,221 | 7/1967 | Trillo | 104/120 |
| 3,358,611 | 12/1967 | Westfall et al. | 104/120 |
| 3,536,232 | 10/1970 | Lightcap | 46/90 X |
| 3,666,174 | 5/1972 | Brylka et al. | 52/2 X |
| 3,696,752 | 10/1972 | Bourg | 104/290 |
| 3,712,240 | 1/1973 | Donlon et al. | 104/290 X |
| 3,759,186 | 9/1973 | Sugimoto | 104/120 |
| 3,865,373 | 2/1975 | Knight | 273/369 |
| 3,937,431 | 2/1976 | Gunter | 104/290 |
| 3,990,532 | 11/1976 | Robinson | 52/2 X |
| 4,128,204 | 12/1978 | Wade | 52/2 X |
| 4,240,212 | 12/1980 | Marshall et al. | 273/348.1 |
| 4,261,579 | 4/1981 | Bowyer et al. | 273/372 |
| 4,281,241 | 7/1981 | Knight et al. | 273/372 X |
| 4,349,728 | 9/1982 | Phillips et al. | 273/372 |
| 4,351,026 | 9/1982 | Phillips | 273/372 |
| 4,385,767 | 5/1983 | Colbourne | 273/359 |

FOREIGN PATENT DOCUMENTS

| | | | |
|---|---|---|---|
| 262849 | 6/1968 | Austria | 273/380 |

*Primary Examiner*—Paul E. Shapiro

*Attorney, Agent, or Firm*—Schwartz, Jeffery, Schwaab, Mack, Blumenthal & Koch

[57] ABSTRACT

Disclosed is a target apparatus for realistically simulating battlefield conditions comprising an inflatable target capable of receiving repeated fire without deflating. The target is mounted on a trolley and moves along a predetermined path and can be rapidly inflated by a source of pressurized air and maintained in an inflated condition. At least one transducer is positioned within the target to detect the passage of a projectile through the target and to differentiate between different caliber projectiles based on their different pressure wave energy levels. An externally positioned projectile position detection apparatus may also be provided.

55 Claims, 8 Drawing Figures

INFLATABLE TARGET APPARATUS

FIELD OF THE INVENTION

The present invention relates to target apparatus and more particularly to target apparatus suitable for use in training personnel, such as military personnel, in the art of the marksmanship.

BACKGROUND OF THE INVENTION

Various targets and target systems for simulating battlefield conditions are known in the art. Bowyer et al, in U.S. Pat. No. 4,261,579 discloses a target system having a plurality of up/down targets and a projectile position measurement system. Gillam et al, in U.S. Pat. No. 3,233,904 discloses an automatic target apparatus where a rigid target member may be shaped to simulate an infantry man or the like with the target position being manipulable from a remote position. Knight, in U.S. Pat. No. 3,323,800 discloses a remote target controlling apparatus with hit counting telemetry and in U.S. Pat. No. 3,682,478 discloses a thin, self-supporting ductile plastic target. In U.S. Pat. No. Re. 30,013, Knight discloses a moving target and target range using a target trolley. In U.S. Pat. No. 4,136,873 Bowyer discloses a target made of polyethylene materials. In U.S. Pat. No. 4,313,182 Knight et al discloses target equipment with a target in the form of a tank and in U.S. Pat. No. 4,330,129 Meredith a portable, foldable target apparatus having a planar target member.

While all of these devices are useful for the purposes disclosed therein a need still exists for an inexpensive, reusable target apparatus which can be used in training for producing a life-like simulation of battle conditions.

SUMMARY OF THE INVENTION

An object of the present invention is to provide a target apparatus that can be utilized to realistically simulate battlefield conditions.

It is a further object of the present invention to provide an inflatable target capable of receiving repeated fire without deflating.

It is a still further object of the present invention to provide a target capable of movement along a predetermined path.

According to the present invention there is provided a target apparatus comprising a bag formed of flexible material, means for introducing compressed air or gas to the interior of said bag to cause the bag to be inflated and a projectile detection arrangement for detecting a projectile fired at the target, the projectile detection arrangement comprising at least one transducer responsive to an airborne pressure wave generated by the projectile. As used herein, the term "pressure wave" is intended to mean either a pressure wave generated by a subsonic projectile or a shock wave generated by a supersonic projectile.

Preferably the transducer arrangement comprises at least one transducer located within the bag when the bag is inflated, the transducer being responsive to a pressure wave generated within the inflated bag by a projectile passing through the bag. The transducer is preferably responsive to a pressure wave of at least a predetermined minimum amplitude and/or duration, although preferably a plurality of transducers are provided within the bag, at least one being responsive to a pressure wave of a predetermined minimum amplitude and/or duration and a second being responsive to a pressure wave of a greater amplitude and/or duration. Thus, in a preferred embodiment, a plurality of transducers are provided each responsive to pressure waves of different amplitudes and/or durations.

Advantageously the transducer arrangement further includes an array of at least three tranducers located on the exterior of the bag, each transducer being adapted to detect a pressure wave generated by a projectile fired at the bag which either passes through the bag or a region adjacent the bag. The transducers are associated with timing and calculating means for determining the relative instant of arrival of a pressure wave at each transducer and to calculate, from the determined instants, information concerning the trajectory of the projectile. Preferably the transducer array comprises at least three transducers located adjacent one side of the target, and three additional transducers located adjacent the opposite side of the target.

The bag may advantageously be inflated by fans, an air pump or the like adapted to direct air into the bag. The fans may comprise a relatively high speed fan, for rapid inflation of the bag, and a relatively low speed fan, for maintaining the bag in an inflated condition. Conveniently the fans have associated filters to filter the air directed into the bag. Preferably the fans are of the reversible flow type, to enable the bag to be rapidly deflated by the exhaustion of air from within the bag. In this way the target apparatus can be made to appear and disappear when viewed from the firing point.

Alternatively the bag can be inflated by a source of compressed air or other gas.

Preferably means are provided to enable the bag, when inflated, to have a predetermined heat signature. This means may comprise a heater associated with the fan or other means to inflate the bag so the bag is inflated with heated air. Certain portions of the wall of the bag are preferably thinner than other portions, the thinner portions transmitting more heat than the thicker areas. Alternatively heat emitting patches can be mounted on the bag. The heat emitting patches may comprise a patch of electrically resistive but conductive material and a means for applying a voltage across the patch. Each patch may preferably be formed of a plastic-type material with graphite particles or the like incorporated therein.

Conveniently the bag is mounted on a trolley, the trolley being movable along a rail and provided with means by which it can be propelled along the rail in either direction. The propelling means may comprise an internal combustion engine, hydraulic or compressed air devices, towing wires, or electrical devices, either battery powered or provided with sliding pick-up means cooperating with a bus bar system mounted on or adjacent to the rail to supply electric power to the trolley. In a preferred embodiment the trolley is provided with a linear motor, the stator of the linear motor being mounted on or formed integrally with the rail, and the trolley may be provided with a sliding pick-up means, cooperating with a bus bar system mounted on or adjacent the rail to supply electric power to the trolley. Means may be provided for relaying information to and/or from the trolley, such as a radio-link, or a bus bar arrangement cooperating with contacts present on the trolley.

Advantageously the rail comprises a rectangular member, and the trolley has wheels to engage an upper surface of the rectangular member, and jockey wheels which engage either the two opposed side surfaces of, or the lower corners of, the rectangular member. The rectangular member may advantageously be a hollow tubular member.

Conveniently the inflatable bag mounted on the trolley provides a representation of a military target such as an infantry man.

Preferably, two trolleys are provided which are interconnected by means of a rigid platform-like structure, the inflatable bag being mounted on the platform and providing a representation of a military target such as a tank.

Preferably means are provided on the trolley or on the rigid platform structure to retain the bag in position on the trolley or platform structure. This retaining means may comprise a series of clamps or the like which clamp the inflated bag in position around the periphery of the trolley or platform structure, thus forming an enclosure comprising the rigid base of the trolley or platform structure and the flexible bag, said enclosure being impervious to the flow of air.

Preferably means are provided to control the condition of the bag during inflation and deflation. This control means may comprise a series of cords attached to the bag at several points and connected to a winching arrangement such that as the bag is inflated the cords are released and as the bag is deflated the cords are winched in, thereby containing the bag material within the periphery of the trolley or platform structure.

Alternatively, a framework may be provided on each trolley to retain the inflated bag in position on the trolley, the framework or the like can be moved from a collapsed condition to an elevated condition—the framework, in the elevated condition, surrounding the inflated bag.

The framework may comprise a plurality of inverted "U" shaped members each pivotally connected to the trolley, and means to move the members from a substantially horizontal position to a substantially vertical position. The moving means may comprise a link member linking together the inverted "U" shaped members, and a driving ram for said link member.

BRIEF DESCRIPTION OF THE DRAWINGS

In order that the invention may be more readily understood, and so that further features thereof may be appreciated, the invention will now be described by way of example with reference to the accompanying drawings in which.

DETAILED DESCRIPTION OF THE PREFERRED EMBODIMENTS

Figure 1:
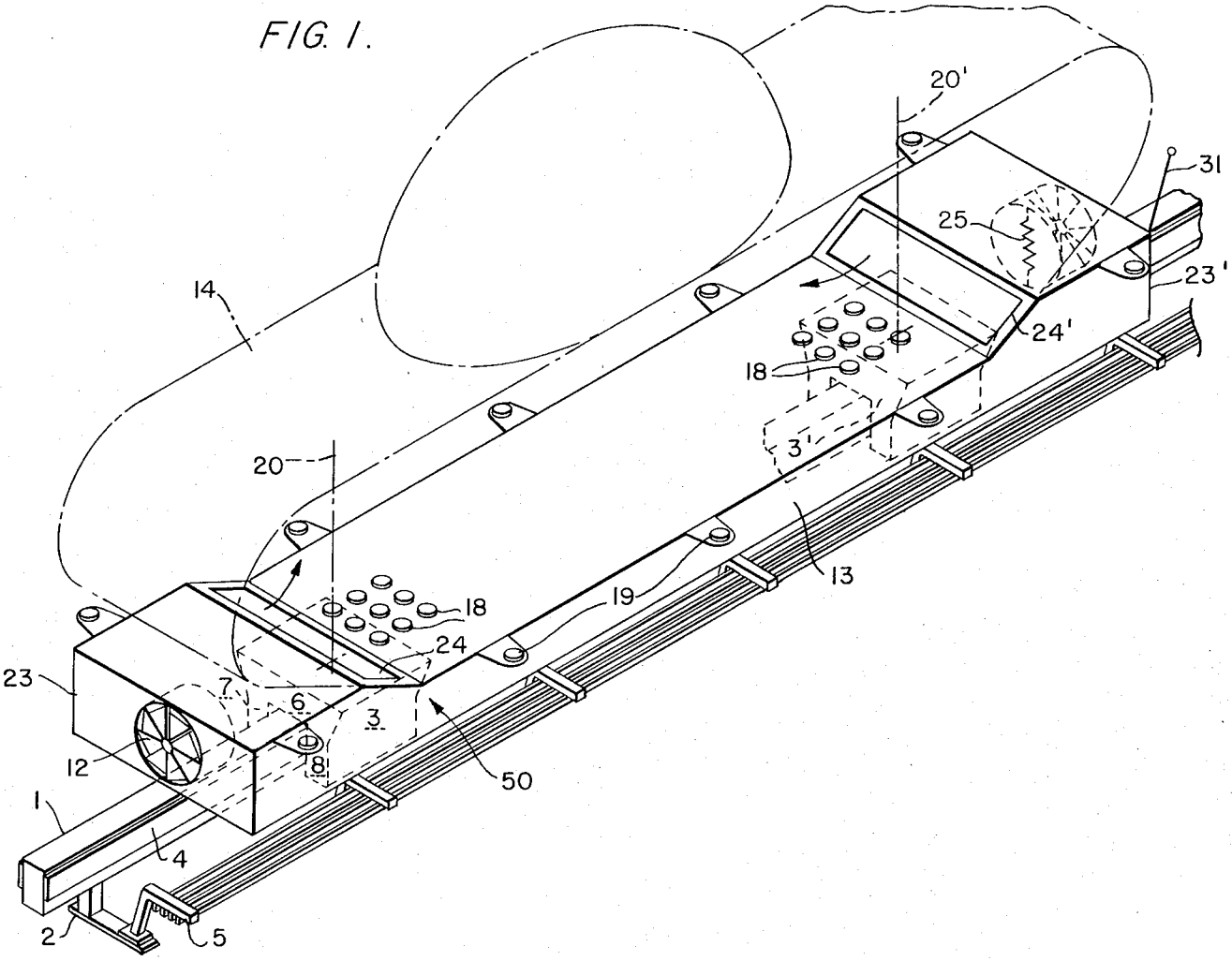
FIG. 1 is a perspective view of one embodiment of the invention.

Reference will now be made in detail to the presently preferred embodiments of the invention, which are illustrated in the accompanying drawings. Turning first to FIG. 1 thereof an embodiment of a shooting range utilizing apparatus in accordance with the invention is illustrated wherein there is provided at least one elongate track 1. The track is formed, for example, of a steel tube having a substantially square or rectangular cross section, which is manufactured within a fine manufacturing tolerance. The tube is supported above ground level by appropriate support means 2, and the arrangement is such that a trolley 3 can run along the track. It should be understood that other track configurations, such as for example an "I" beam or a plurality of elongate members separated by webs can also be used within the spirit of the invention.

Referring to the track of FIG. 1, secured to one or both side edges of the steel tube is a strip of a metal such as aluminum 4, which forms the stator of a linear motor, which will presently be described. Also mounted adjacent to one side of the track is a sliding connector bus bar system 5, which comprises the stationary part of the bus bar system.

Figure 2:
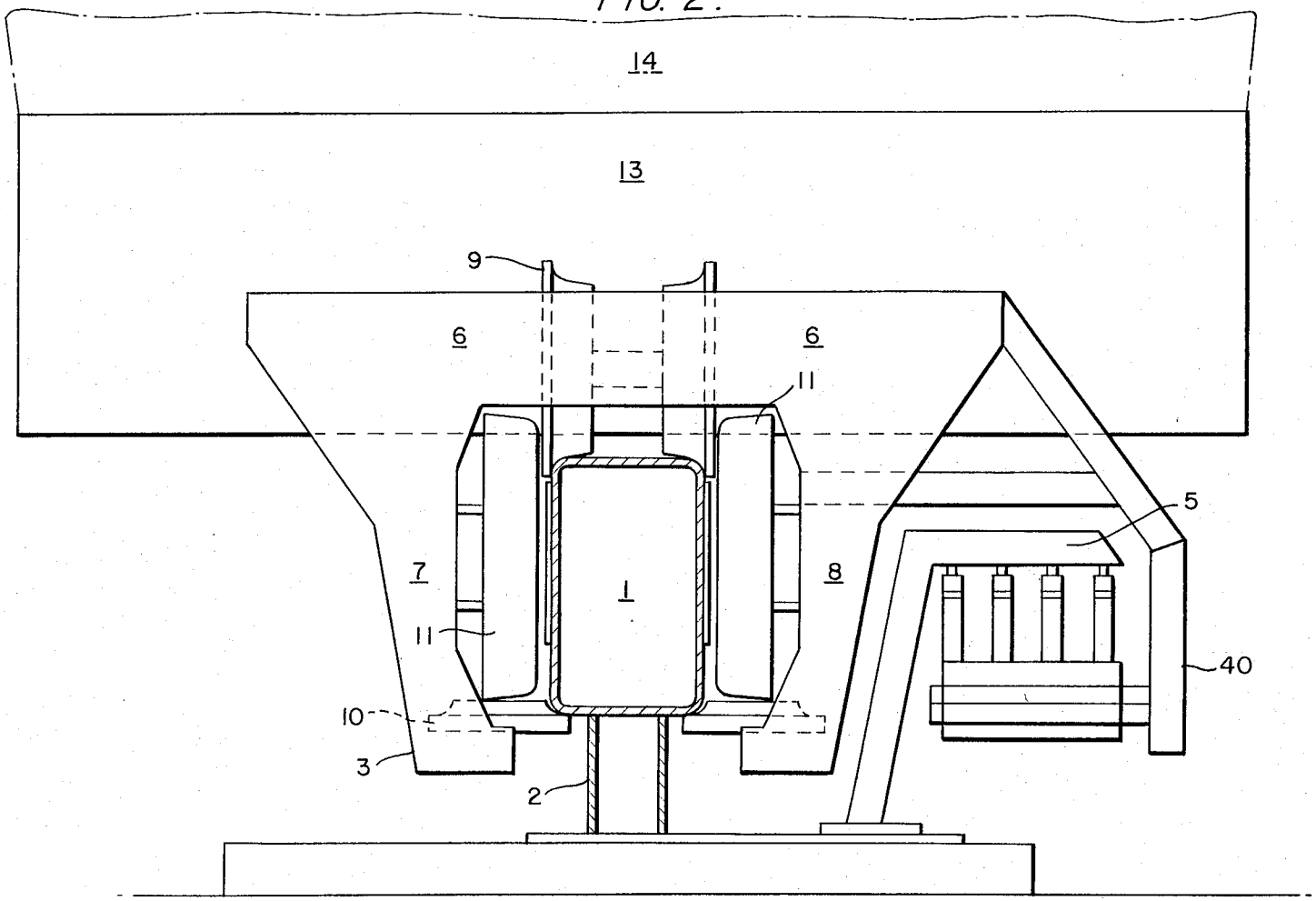
FIG. 2 is an end elevational view of part of the apparatus shown in FIG. 1.

Referring now to FIG. 2, the trolley 3 is mounted for movement along the track. Preferably, the trolley has a portion 6 extending across the top of the track, and two portions 7, 8 extending downwardly on either side of the track. Wheels 9 are provided within the trolley which are generally vertically mounted and which support the trolley on the top of the track 1. Jockey wheels 10 may also be provided within the trolley, the jockey wheels being substantially horizontal and engaging the side walls of the track 1. Other support wheel and jockey wheel configurations are known in the art and come within the scope of the invention. The trolley is provided with a linear motion 11 in each side 7, 8 of the trolley adjacent the side of the track. As best seen in FIG. 1, a trolley support assembly 50 is provided at each end of the trolley so that four linear motors are provided in all. As mentioned above, the stator 4 for the linear motors is securely connected to the tubular track. The trolley is also provided with a sliding connector 40 that cooperates with the fixed part 5 of the bus bar system provided adjacent to the track so that electrical power and various control signals can readily be supplied to the trolley.

In the embodiment illustrated a trolley-train is provided, comprising two trollies, 3, 3' that are interconnected by a rigid platform, 13, the platform being mounted in such a way that each trolley may pivot about a vertical axis, 20 and 20' respectively, with respect to the platform.

Mounted on each end of the platform is a source 12 of pressurized gas. In the embodiment of FIG. 1 a high speed fan and an associated motor for driving the high speed fan comprise the source 12. Each high speed fan is mounted within a housing, 23 and 23' respectively, which is provided at one end of the platform, the housing 23 being open to permit the ingress of air to the blades of the fan, and having an open upper exhaust port 24, through which air is driven by the fan.

The top of the platform, which is substantially air impervious, preferably extends over the side edges of the trolley and may extend over the forward and rearward end of the trolley. Mounted to the periphery of the platform is the open mount of an inverted bag 14 formed of a resilient plastic material or the like. The bag is mounted to the trolley in a generally air-tight manner so that it will be inflated by operation of the source 12, whereupon the bag will stand in an erect position above the platform. The lower most portions of the side walls of the bag are relatively thick in comparison to upper, progressively thinner portions of the bag, thus providing these regions of the side walls of the bag with a certain degree of rigidity.

Figure 4:
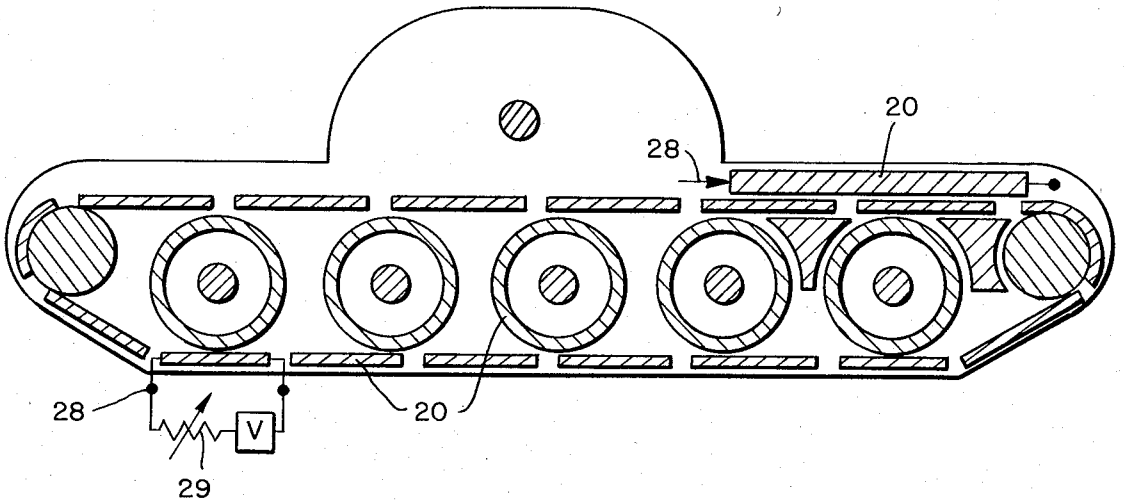
FIG. 4 is a diagrammatic side elevational view of a target constituted by the inflated bags carried on the trollies of FIG. 1 showing heat emitting patches secured thereto.

In one advantageous embodiment of the invention, the bag 14 is disposed on a platform 13 carried by two trolleys of a train of trolleys 3, 3'. When viewed from the side this embodiment may advantageously be fashioned to resemble a tank profile as seen in FIG. 4. Thus, it will be appreciated that the bag 14, when inflated, may be utilized as a target for training personnel in the art of marksmanship.

It will be appreciated that the target can be caused to move along, by means of the linear motors, and the arrangement is such that the target can run along the rail at any appropriate speed up to approximately 65 kilometers per hour in either direction. At least one trolley is provided with pick-up means 40 which cooperates with the bus bar 5 provided on the rail to ensure that the power can be supplied to the linear motors and to ensure that appropriate control signals can be provided to the trolley and also to ensure that appropriate signals can be taken from the trolley to a central processing or control station. These signals may, for example, be mains injected on the power line. In alternative embodiments a radio link 31 may be provided between each trolley and a central control position, such as the CPU of FIG. 1B.

Since the trolleys are intended to travel at substantial speeds, it should be appreciated that a bag constituting a target, may be subjected to severe wind pressure particularly if the trolley is moving against a head wind. In the inflated state the bag material is held generally rigid and taut due to the internal pressure in the bag. When deflated, the bag lays flat on the trolley and is not subjected to wind loads. During inflation and deflation, however, the wind loads are present and the bag material is not maintained in a taut condition. There will be a tendency, therefore, for the bag to billow about, possibly resulting in damage.

Figure 3:
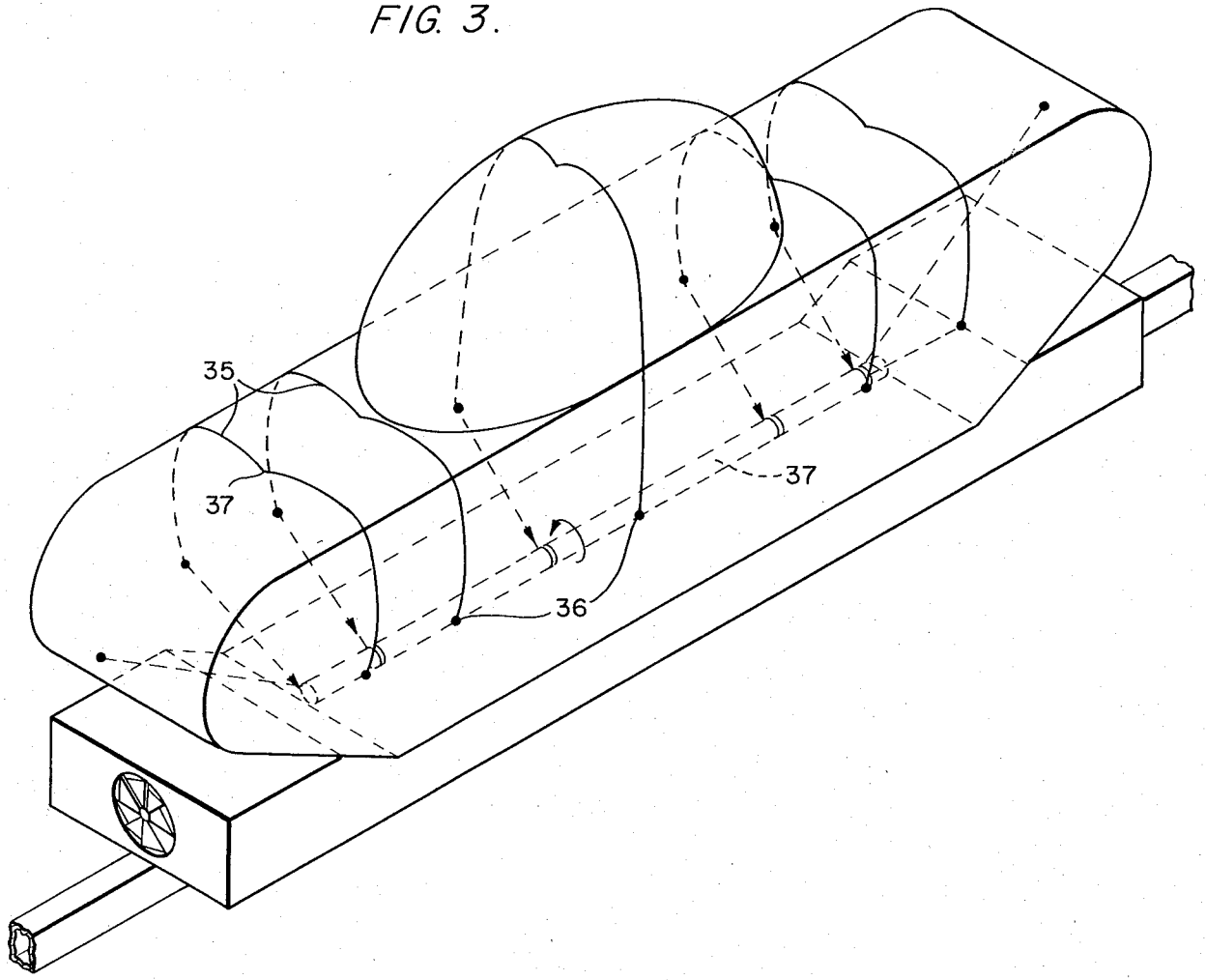
FIG. 3 is a perspective view of the platform illustrated in FIG. 1, illustrating a first embodiment of a bag retaining device with control cords and a winching arrangement.

To prevent such damage occurring it is proposed to provide a series of cords 35 (see FIG. 3) which are attached to the target bag at 37 in the center of the bag, pass around the outside of the target bag, pass through eyelets 36 in the target bag and are wrapped onto a winch drum 37 mounted on the trolleys or platform. Thus when it is desired to deflate the bag, the winch is operated to effectively shorten the cords by rotating the winch and thereby wrapping the cords around the winch and consequently constraining the bag to deflate within the periphery of the trolley or platform.

Figure 3A:
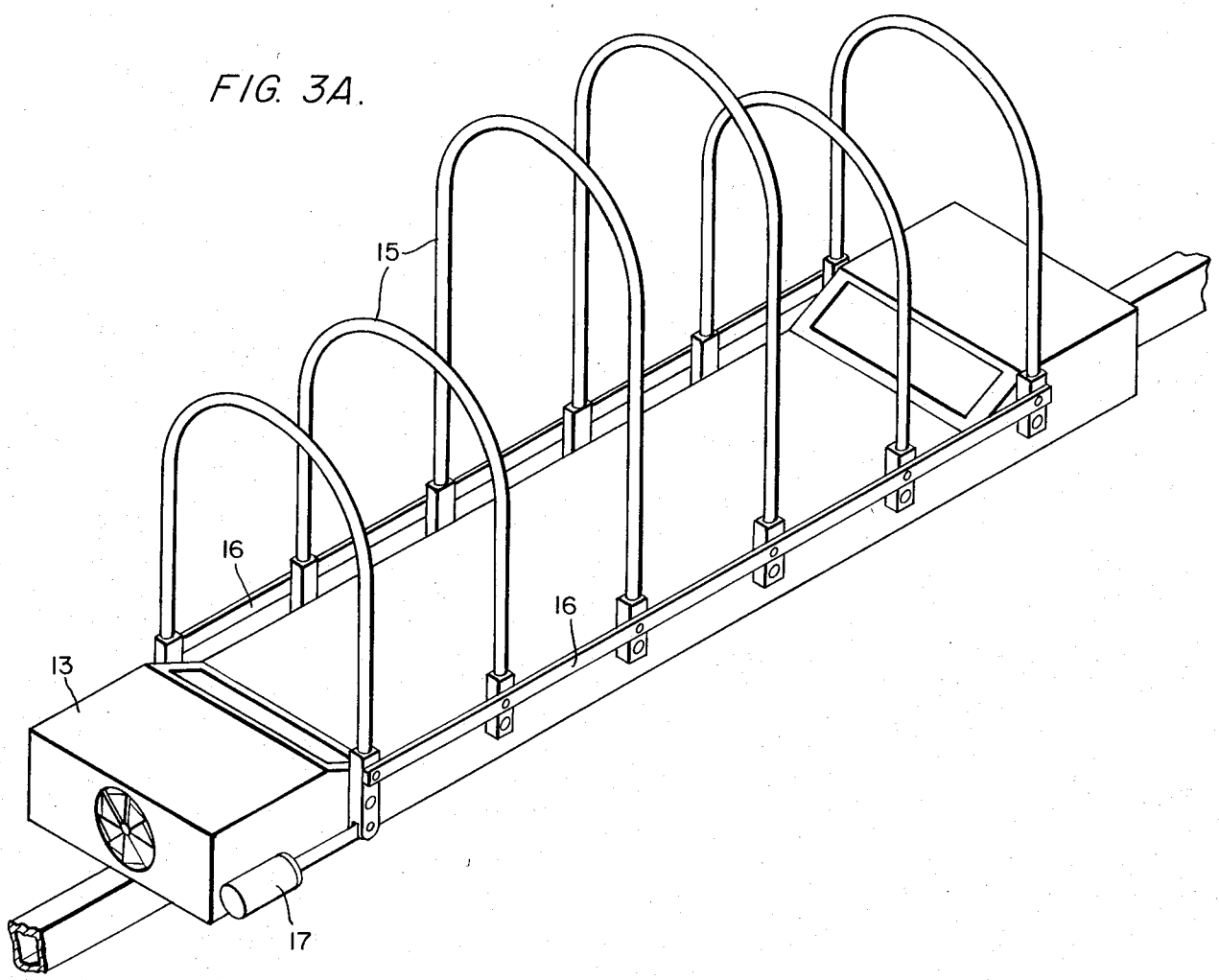
FIG. 3A is a diagrammatic view of the platform illustrated in FIG. 1, with the inflatable bags omitted, illustrating a second embodiment of a bag retaining device.

Alternatively, in order to prevent an inflated target from being blown from its desired position relative to the trolley, a framework (see FIG. 3A) may be provided which comprises inverted "U" shaped elements 15 which are pivotally connected at the free ends of the arms of the "U" and mounted on the trolley-train at the sides of the platform 13. The members are all adapted to move in synchronism and may thus be interconnected by an elongate link member 16 which is actuated by an appropriate ram 17 under the control of a limit switch. Thus, when it is intended to inflate the bag that constitutes the target, the ram 17 is operated to move the inverted "U" shaped members 15 to an upright position. The members then effectively defining a "cage" which surrounds the volume of space that is to accommodate the inflated bag. The bag then inflates and is trapped within the "cage".

It is to be noted that since the trolleys travel at relatively high speeds, it is important that both the trolleys and the rails be manufactured to within fine manufacturing tolerances so that, as the trolleys move around corners at a high speed the linear motors do not become separated from the aluminum strips to such an extent that the operation of the linear motors is adversely affected.

Referring again to FIG. 1, in order to determine whether any particular inflated bag 14 has been penetrated by a projectile, at least one transducer 18 is provided within the inflated bag, preferably on the platform 13. The transducer is responsive to a pressure wave generated in the air within the bag by a projectile fired at the bag actually passing through the bag. Thus, whenever the transducer receives a pressure wave, an output signal will be generated by the transducer, this output signal being indicative of a hit on the target. Such a transducer positioned within a three-dimensional target is further explained in U.S. Pat. No. 4,349,729 to Knight, the disclosure of which is hereby incorporated by reference.

It is to be appreciated that a range as presently described may be utilized with many different types of ammunition being fired at the target simultaneously. It may be necessary to be able to determine, with regard to each particular "hit" the precise type of ammunition utilized. Consequently it is proposed to utilize, within each bag, a plurality of transducers 18, each transducer having a separate and distinct threshold with regard to the amplitude and/or duration (i.e. energy) of the detected pressure wave. Thus, the transducer that responds to the shortest and/or lowest caliber to be fired at the target will be detected. The transducer responsive to the pressure or shock wave of the next largest amplitude and/or duration will ensure that projectiles of the next largest caliber size will be detected. Of course, when a projectile of this next largest caliber size passes through the target, both this transducer and the first described transducer will provide output signals since each transducer will respond to any pressure or shock wave that has an energy greater than the threshold level of that transducer. As will be appreciated by one of skill in the art, the transducers may be provided with threshold filters having threshold levels tailored to detect various caliber ammunition. The use of a threshold filter in connection with such a transducer is known from the above-mentioned U.S. Pat. No. 4,349,729.

It is envisaged that a plurality of transducers (or transducers equipped with threshold filters) may be provided, the transducers effectively being "tuned" to detect 7.62 mm projectiles, 30 mm projectiles, 40 mm projectiles, 76 mm projectiles, 95 mm projectiles, 105 mm projectiles and 120 mm projectiles. Of course further transducers may be provided "tuned" to any particular projectile size.

It is important to note that if only a single transducer is utilized to provide an output signal for each caliber of ammunition, it may not be capable of detecting a pressure wave from a projectile of the appropriate caliber if that projectile penetrates the inflated bag that constitutes the target at a position remote from the transducer. Consequently, it may be necessary to provide a plurality of groups of transducers on the platform supported by the trolley to ensure that, whenever a projectile passes through an inflated target, an appropriate output signal is generated.

The transducers 18 are illustrated as defining a regular square array, but it should be appreciated that many alternative configurations for the transducers such as hexagonal array or the like may be acceptable. It is only important that an appropriate signal be generated when a projectile passes through the inflated target.

Instead of using separate transducers, a single transducer may be used with means to measure the amplitude and/or duration of the output signals, the measured values being supplied to an appropriately programmed microprocessor or the like to provide an indication of the size of the projectile. The transducer may be similar to that disclosed by Phillips in U.S. Pat. No. 4,359,659 or by Knight et al in U.S. Pat. No. 4,282,453, the disclosures of which are hereby incorporated by reference.

Figure 1A:
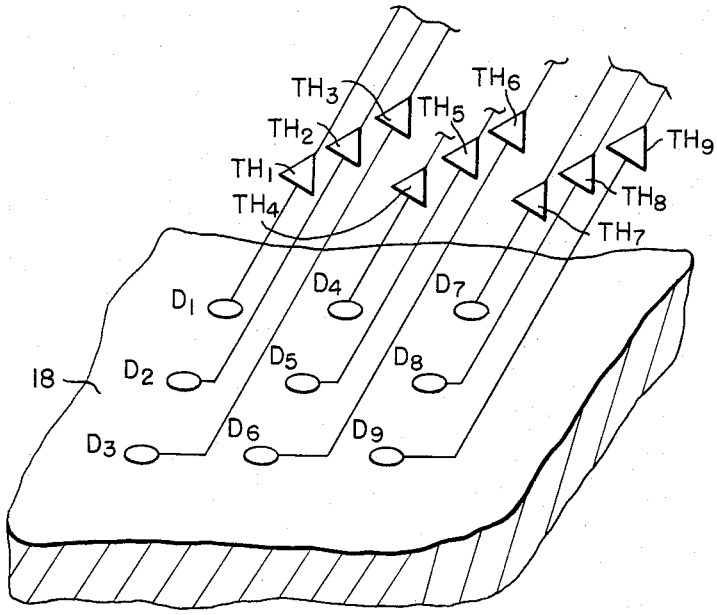
FIG. 1A is a diagrammatic view of the transducer array of FIG. 1.

In FIG. 1A, a transducer array 19 comprising transducers D1 through D9 are illustrated. Each of the transducers has an associated threshold detector TH1 to TH9 respectively tuned to a specific caliber of ammunition.

Figure 1B:
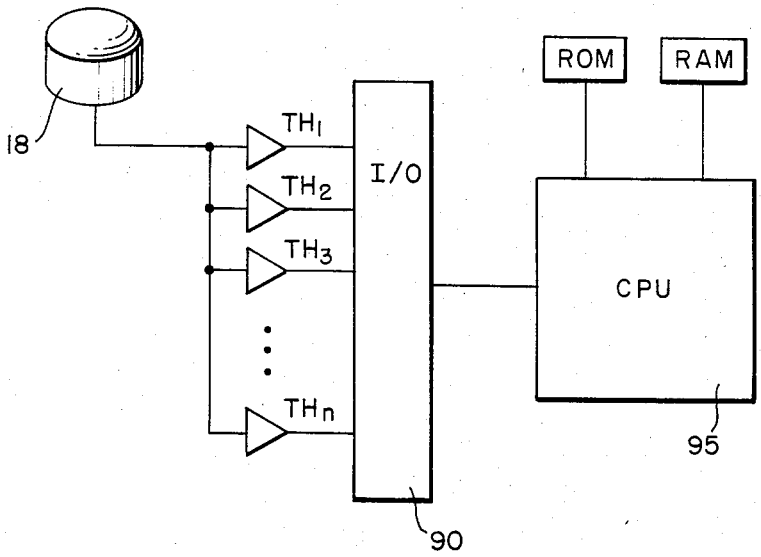
FIG. 1B is a diagrammatic view of another embodiment of a pressure transducer.

In FIG. 1B, the array of transducers is replaced by a single transducer 18 having associated threshold devices $TH_1$ to $TH_n$, each tuned to detect a specific caliber of ammunition.

In either of these embodiments, a projectile which creates a pressure or shock wave of a certain energy will send a signal to a microprocessor or the like through an input/output device 90, thus enabling a microprocessor 95 having an appropriate RAM and ROM to determine the caliber of the projectile.

It may also be desirable to be able to provide an output signal indicative of precisely where a bullet or projectile has impinged upon or passed adjacent the target constituted by the inflated bag. For projectile position detection, there are advantageously mounted, on each side of the trolley, a row of transducers 19, each of which provides an output signal in response to detection of a pressure or shock wave generated by a projectile fired at the target, constituted by the inflated bag. These output signals are processed in an appropriately programmed computer such as the CPU 95 of FIG. 1B or a timing device such as the device 30 of FIG. 5, both of which are adapted to calculate, from the time delays between the instants of generation of the output signals generated by the transducers 19, information concerning the trajectory of the projectile. Apparatus of this type has been described, primarily with reference to permanently fixed range equipment, in U.S. Pat. No. 4,281,241, U.S. Pat. No. 4,282,453 and in U.S. Pat. No. 4,357,531, all of which are hereby incorporated by reference. It will readily be appreciated, however, that the operative components of such a system may be mounted on a trolley of the type herein described on appropriate outriggers. Of course, it may be desirable for the necessary computer to be located at a central point, and thus it is envisaged that the information concerning the time of arrival of the pressure wave at each transducer 19 will be transferred to a computer either by means of mains injection through the power line or by means of an appropriate radio link such as antenna 31 of FIG. 1.

From the foregoing description it will be appreciated that when the inflatable bag 14 of a target apparatus in accordance with the invention is inflated, the complete target will have the visual appearance of a tank or other military target. In order to facilitate night training, and training in connection with the use of heat sensitive sights, it is advantageous to provide means on the target to generate a heat signature. Such a heat signature may be generated by providing each fan 12 with a heater 25 adapted to heat the air being introduced into the bag. In this way, the bag, when inflated, is relatively warm and thus the inflated bag can readily be viewed through heat sensitive sights. Whenever a projectile passes through such a bag hot air escapes from the bag, and again this can readily be seen on heat sensitive sights.

It should be appreciated that while the heat signature outlined above provides one way in which training can be given in the use of heat sensitive sights, the resulting training may be rather unrealistic since, in real life, a military target such as tank does not provide an even heat image. Rather, there are certain areas that, in use, are much hotter than others. For example, in a normal tank the racks, the drive wheels, and the zone immediately surrounding the exhaust from the engine of the tank tend to be hot in use. It is therefore preferable to provide a corresponding simulated effect by manufacturing the inflatable bag of a material that has thin zones where the target being simulated tends to become hot in use, and thick zones where the target being simulated does not tend to become hot in use. Alternatively, it may be preferred to provide heat emitting patches or zones 20 on the inflatable bag as illustrated in FIG. 4. Such emitting patches or zones may comprise appropriately shaped sheets of a conductive plastics material, such as polyethylene incorporating graphite or some other similar arrangement, each such sheet being provided with electrodes 28 along two opposed edges thereof, and a voltage source v, such as a connection to the aforementioned bus-bar system, for applying a voltage across the electrodes. Advantageously the voltage to each patch is controllable by a rheostat 29 or the like so that the amount of current flowing through each conductive sheet may be adjusted, and consequently the temperature of the sheets may be adjusted to simulate the temperature profile of an actual tank or the like.

In FIG. 4, patches 20 of the type described above are represented by the hatched areas and are mounted on an inflatable bag target of the type described above in the regions of the target which, in a real target, would be hot—that is to say the regions in the example of a tank, corresponding to the wheels and the tracks and to the exhaust outlet. With the use of such patches, when the target is viewed through a heat sensitive sight the image of the target is virtually identical with the image of a real target, and thus very realistic training may be provided.

Where a target apparatus of the type described above is to be utilized on a training range that simulates a theater of war, it is desirable that the bags may be fully inflated from a totally deflated condition in a very short period of time, so that a trolley can advance with the bag deflated, unobserved by trainee marksman within the range, and then, when the trolleys are in the desired positions, the bags may be rapidly inflated, thus providing a visual representation of the rapid appearance of tanks. In more advanced ranges the trolleys utilized may carry targets resembling "friendly" tanks and targets resembling "enemy" tanks and the marksman within the training area will first have to identify any particular target before firing at the target.

It is to be appreciated that the rapid inflation of any particular bag that constitutes a target is a desirable feature and consequently it is preferred to utilize fans that operate at a high speed, to ensure that the bag can be inflated rapidly. It is, of course, possible to utilize one or more high speed fans for rapid inflation of the target and an additional low speed fan which can be utilized to maintain the target in an inflated condition once the target has been inflated. This will minimize the power consumption and may prove to be beneficial, particularly where the fans are battery operated. Preferably the fans are provided with appropriate filters to ensure that only pure air is directed to the interior of any particular bag.

While the invention has been described with reference to the use of fans it is to be appreciated that other sources of air or gas may be utilized on such as cylinders of compressed air or gas, or even a central compressor and associated supply lines and valves. Such an expedient may be adopted particularly where inflatable bag targets of the type generally described above are not mounted on a trolley, but are mounted on a permanent or semi-permanent base.

If necessary, when battery operated, a fan may be pulsed to provide optimum performance.

Figure 5:
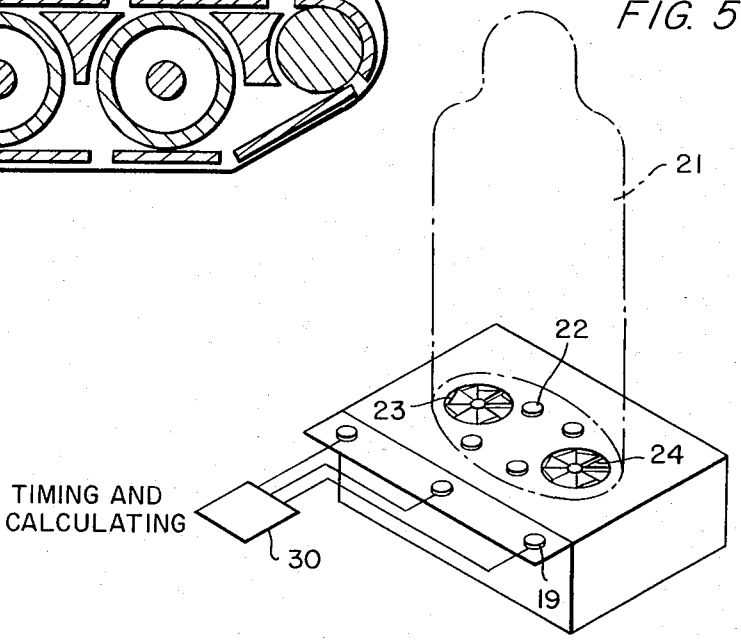
FIG. 5 is a perspective view of another target in accordance with the invention.

While the invention has been described above primarily with regard to relatively large targets mounted on trolleys which resemble tanks or the like, it is to be appreciated that the invention may be applied to other targets such as, for example, a relatively small inflatable target 21 having the shape and configuration of an infantry man as shown in FIG. 5. When such a target is utilized, a bag having the shape and appearance of an infantry man can rapidly be inflated, thus providing a visual simulation of an enemy infantry man emerging from a concealed position. One or more transducers 22 will be provided within the inflatable bag adjacent the base thereof, the transducers serving to detect projectiles passing through the inflatable bag target. In such an embodiment two fans 23, 24 may be provided, one being a high speed fan for rapid inflation of the target, and the second being a relatively low speed fan, primarily to maintain the target in an inflated condition after it has been penetrated by one or more projectiles.

In this embodiment of the invention also a plurality of transducers 19, analogous to the transducers 19 of FIG. 1, are provided in positions adjacent the exterior of the target to provide information concerning the position of a bullet or other projectile fired at the target. Again, the arrangements of transducers and information processors utilized may be as described in the above-mentioned U.S. Pat. Nos. 4,281,241, 4,282,453 or 4,357,531. It is to be appreciated that when such arrays of transducers are utilized, together with an appropriate timing and calculating device 30, it is possible to determine not only the position of bullets that actually hit the target, but also the position of bullets that, while passing in the general vicinity of the target, do not actually hit the target.

It will be appreciated that the above described apparatus may be utilized to fabricate a very realistic and life-like training range, offering training facilities during the day and at night, and also specifically offering training facilities in connection with the use of heat sensitive weapon sights.

It should also be appreciated that due to the action of the fans, air pumps or other sources of pressurized air, targets according to the present invention will remain inflated even after sustaining one or more direct hits from projectiles. However, if penetrated by a great number of small projectiles or a large projectile such as an artillary shell, the target is easily repairable by applying a patch over any shell hole or the like utilizing an appropriate shaped section of bag material and a suitable glue. Thus, the target is repeatedly repairable unless severly damaged.

The foregoing description of the preferred embodiments of the invention have been presented for purposes of illustration and description. They are not intended to be exhaustive or to limit the invention to the precise forms disclosed, and obviously many modifications and variations are possible in light of the above teachings. It is intended that the scope of the invention be defined by the claims appended hereto.

I claim:

1. A target apparatus comprising:

a bag formed of flexible material;

means for inflating said bag; and a projectile detection means disposed within said bag for detecting a projectile hit on the inflated bag, the projectile detection means comprising a transducer arrangement responsive to an airborne pressure wave generated when a projectile passes through the inflated bag, said transducer arrangement being operable to discriminate between projectile hits and misses and to discriminate between pressure wave energy levels, above a minimum threshold level, created by projectiles of different caliber.

2. An apparatus according to claim 1, wherein the transducer arrangement comprises a single transducer.

3. An apparatus according to claim 2, wherein the transducer means is non-responsive to a pressure wave below a predetermined energy.

4. An apparatus according to claim 2 or 3, wherein a plurality of transducer arrangements are provided within said bag.

5. An apparatus according to claim 4, wherein each transducer arrangement comprises a plurality of transducers, at least one of said transducers being responsive to a pressure wave of a first predetermined energy and at least a second of said transducers being responsive to a pressure wave of a second greater energy.

6. An apparatus according to claim 5, wherein a plurality of transducers are provided, each responsive to pressure waves of different energy.

7. An apparatus according to claim 1 or 2 or 3, wherein said transducer arrangement further includes an array of at least three transducers located exterior of the bag, each of said at least three transducers being operable to detect a pressure wave generated by a projectile fired at the bag and either passing through the bag or through a region adjacent the bag, said at least three transducers having associated timing and calculating means operable to determine relative instants of arrival of the pressure wave at each of said at least three transducers and to calculate, from the determined instants, the trajectory of the projectile.

8. An apparatus according to claim 7, wherein said transducer array comprises at least three transducers located adjacent one side of the target, and three further transducers located adjacent the opposite side of the target.

9. An apparatus according to claim 7, wherein the said means for inflating the bag comprises fan means for directing air into the bag.

10. An apparatus according to claim 9, wherein said fan means comprises at least one relatively high speed fan, for rapid inflation of the bag, and at least one relatively low speed fan, for maintaining the bag in an inflated condition.

11. An apparatus according to claim 9, wherein the fan means is of the reversible flow type.

12. An apparatus according to claim 7, wherein the said means for inflating the bag comprises a source of compressed air.

13. An apparatus according to claim 7 including means for providing said bag, when inflated, with a predetermined heat signature.

14. An apparatus according to claim 13, wherein said means comprises heat emitting patches mounted on the bag.

15. An apparatus according to claim 13, wherein said means for providing a heat signature further comprises a heater associated with the means to inflate the bag with heated air and wherein said bag has walls, predetermined portions of said walls being thinner than other portions to transmit more heat therethrough.

16. An apparatus according to claim 7 further including a trolley and a rail, wherein the bag is mounted on the trolley, the trolley being movable along the rail, and a propulsion means for moving the trolley means along the rail in either direction.

17. An apparatus according to claim 16, wherein the trolley is provided with a linear motion having a stator operatively associated with the rail.

18. An apparatus according to claim 17, wherein said rail comprises a rectangular member having an upper surface and opposing side surfaces, said trolley further comprises wheels for engaging the upper surface, and jockey wheels for engaging the two opposed side surfaces.

19. An apparatus according to claim 16, wherein the inflatable bag mounted on the trolley further comprises a representation of a military target.

20. An apparatus according to claim 16, further comprising two trolleys and a rigid platform connecting said trolleys, said inflatable bag being mounted on the platform and providing a representation of a military target.

21. An apparatus according to claim 16, further including means for retaining the inflated bag in a fixed position on the trolley, said means comprising a collapsible framework that can be moved to an elevated condition, said framework in the elevated condition surrounding said inflated bag.

22. An apparatus according to claim 16, further including means for controlling the bag during inflation and deflation comprising a winch and a series of cords attached to the bag and the winch.

23. An apparatus according to claim 1, wherein said transducer arrangement comprises a plurality of transducers, at least one of said transducers being responsive to a pressure wave of a first predetermined energy and at least a second of said transducers being responsive to a pressure wave of a second greater energy.

24. An apparatus according to claim 23, wherein a plurality of transducers are provided, each responsive to pressure waves of different energy.

25. An apparatus according to claim 1, wherein the said means for inflating the bag comprises fan means for directing air into the bag.

26. An apparatus according to claim 25, wherein the fan means is of the reversible flow type.

27. An apparatus according to claim 1, wherein the said means for inflating the bag comprises a source of compressed air.

28. An apparatus according to claim 1 including means for providing said bag, when inflated, with a predetermined heat signature.

29. An apparatus according to claim 28, wherein said means for providing a heat signature further comprises a heater associated with the means to inflate the bag with heated air and wherein said bag has walls, predetermined portions of said walls being thinner than other portions to transmit more heat therethrough.

30. An apparatus according to claim 28, wherein said means comprises heat emitting patches mounted on the bag.

31. An apparatus according to claim 30, wherein each heat emitting patch comprise a patch of electrically resistive but conductive material, and means for applying a voltage across said material.

32. An apparatus according to claim 31, wherein said material comprises a plastics material having graphite particles therein.

33. An apparatus according to claim 1 further including a trolley and a rail, wherein the bag is mounted on the trolley, the trolley being movable along the rail, and a propulsion means for moving the trolley means along the rail in either direction.

34. An apparatus according to claim 33, wherein the rail has an associated bus-bar system operatively associated with the rail for supplying electric power to the trolley, having a sliding pickup means for operatively engaging said bus-bar system.

35. An apparatus according to claim 34, wherein said trolley further comprises data transmission means for relaying information.

36. An apparatus according to claim 35, wherein the data transmission means comprises a radio-link.

37. An apparatus according to claim 35, wherein the data transmission means includes said bus bar and said pick-up means on said trolley for operatively engaging said bus bar.

38. An apparatus according to claim 33, wherein the trolley is provided with a linear motion having a stator operatively associated with the rail.

39. An apparatus according to claim 38, or 34, wherein said rail comprises a rectangular member having an upper surface and opposing side surfaces, said trolley further comprises wheels for engaging the upper surface, and jockey wheels for engaging the two opposed side surfaces.

40. An apparatus according to claim 39, wherein said rectangular member is a hollow tubular member.

41. An apparatus according to claim 33 or 35, wherein the inflatable bag mounted on the trolley further comprises a representation of a military target.

42. An apparatus according to claim 33 or 35 further comprising two trolleys and a rigid platform connecting said trolleys, said inflatable bag being mounted on the platform and providing a representation of a military target.

43. An apparatus according to claim 42, wherein said bag provides a representation of a tank.

44. An apparatus according to claim 42 further including means for retaining the inflated bag in a fixed position on the trolley, said means comprising a collapsible framework that can be moved to an elevated condition, said framework in the elevated condition surrounding said inflated bag.

45. An apparatus according to claim 42 further including means for controlling the bag during inflation and deflation comprising a winch and a series of cords attached to the bag and the winch.

46. An apparatus according to claim 45, wherein said winch is attached to said platform.

47. An apparatus according to claim 45, wherein said winch is attached to said trolley.

48. An apparatus according to claim 33 or 35 further including means for retaining the inflated bag in a fixed position on the trolley, said means comprising a collapsible framework that can be moved to an elevated condition, said framework in the elevated condition surrounding said inflated bag.

49. An apparatus according to claim 48, wherein said framework comprises a plurality of inverted "U" shaped members each pivotally connected to the trolley, and means to move said members from a substantially horizontal position to a substantially vertical position.

50. An apparatus according to claim 49, wherein said moving means comprises a link member linking together said inverted "U" shaped members, and a driving ram for said link member.

51. An apparatus according to claim 33 or 35 further including means for controlling the bag during inflation and deflation comprising a winch and a series of cords attached to the bag and the winch.

52. An apparatus according to claim 51, wherein said winch is attached to said platform.

53. An apparatus according to claim 51, wherein said winch is attached to said trolley.

54. A target apparatus comprising:

a bag formed of flexible material;

fan means for directing air into the bag to inflate the bag, said fan means comprising at least one relatively high speed fan, for rapid inflation of the bag, and at least one relatively low speed fan, for maintaining the bag in an inflated condition; and a projectile detection means for detecting a projectile hit on the inflated bag, the projectile detection means comprising a transducer arrangement responsive to an airborne pressure wave generated when a projectile passes through the inflated bag.

55. An apparatus according to claim 54 further including filters associated with said fan means to filter the air being directed into the bag.

* * * * *